US008246757B2

(12) United States Patent
Nowack

(10) Patent No.: US 8,246,757 B2
(45) Date of Patent: Aug. 21, 2012

(54) PYROLYSIS METHODS AND OVENS THEREFOR

(76) Inventor: William C. Nowack, Destin, FL (US)

( * ) Notice: Subject to any disclaimer, the term of this patent is extended or adjusted under 35 U.S.C. 154(b) by 868 days.

(21) Appl. No.: 11/093,361

(22) Filed: Mar. 30, 2005

(65) Prior Publication Data

US 2006/0225770 A1 Oct. 12, 2006

(51) Int. Cl.

| | |
|---|---|
| ***B08B 5/00*** | (2006.01) |
| ***F27B 9/10*** | (2006.01) |
| ***F27D 7/02*** | (2006.01) |
| ***F27D 7/06*** | (2006.01) |

(52) U.S. Cl. ..... 134/19; 134/30; 134/31; 134/36; 134/37; 134/38; 134/2; 110/348; 432/1; 432/23; 432/24

(58) Field of Classification Search ..... 134/2, 19, 134/38, 16, 17, 39, 40, 42, 31, 1, 5, 20; 110/229, 110/236

See application file for complete search history.

(56) References Cited

U.S. PATENT DOCUMENTS

| | | | | | |
|---|---|---|---|---|---|
| 1,416,865 | A | * | 5/1922 | Patch | 134/2 |
| 3,847,664 | A | * | 11/1974 | Gravel | 134/2 |
| 4,038,152 | A | | 7/1977 | Atkins | |
| 4,141,373 | A | | 2/1979 | Kartanson et al. | |
| 4,766,822 | A | * | 8/1988 | De Cicco et al. | 110/212 |
| 4,924,785 | A | * | 5/1990 | Schultz et al. | 110/346 |
| 4,970,969 | A | * | 11/1990 | Koptis et al. | 110/190 |
| 5,018,458 | A | | 5/1991 | McIntyre et al. | |
| 5,236,470 | A | | 8/1993 | Levin | |
| 5,302,254 | A | | 4/1994 | Martin et al. | |
| 5,351,632 | A | * | 10/1994 | Mann | 110/190 |
| 5,423,951 | A | | 6/1995 | Wienert | |
| 5,820,736 | A | | 10/1998 | Bouziane et al. | |
| 5,821,396 | A | | 10/1998 | Bouziane | |
| 5,868,085 | A | | 2/1999 | Hansen | |
| 5,868,565 | A | * | 2/1999 | Nowack | 432/128 |
| 6,520,097 | B2 | * | 2/2003 | Shiveley | 110/236 |
| 6,748,881 | B1 | * | 6/2004 | Heran et al. | 110/346 |

OTHER PUBLICATIONS

CRC Handbook of Chemistry and Physics, 89th Edition, 2008-2009, Physical Constants of Inorganic Compounds.*

* cited by examiner

*Primary Examiner* — Michael Kornakov
*Assistant Examiner* — Natasha Campbell
(74) *Attorney, Agent, or Firm* — Marshall A. Burmeister

(57) ABSTRACT

Pyrolysis methods for disassociating an organic mass, or coating from an article, by placing the article in an air tight processing chamber, circulating a gaseous mixture of ambient air and at least 40% water vapor from an opening, through the processing chamber and out of an exhaust port, and maintaining the processing chamber at a temperature above 650 degrees Fahrenheit for a sufficient time to disassociate the organic material. A batch oven and a continuous processing oven including entrance and exit air closures that utilize the pyrolysis methods are described.

15 Claims, 5 Drawing Sheets

PYROLYSIS METHODS AND OVENS THEREFOR

This invention relates to methods for treating organic materials by pyrolysis, such as treating articles to remove a surface coating, particularly, to removal of paint or other surface coating from articles. This invention also relates to ovens for performing such processes.

BACKGROUND OF THE INVENTION

In industry, there are a number of reasons for removing a surface coating from the base of a manufactured item, such as a defect in the coating, or to change the color of the coating, or to recover scrap. Also, the industrial painting process for such articles often mounts the bases to be painted on a hook carried by an overhead conveyor, and paint is applied to the base by immersion, as a liquid spray or a powdered coating. In such manufacturing processes, the hangers become covered with paint and require periodic stripping to prevent paint chips from the hangers falling on and damaging the newly applied coating during heat curing of the base.

There are three basic methods in the prior art for removing the surface coating from a base, namely, abrasive buffing, application of chemicals for removing the material of the coating, and pyrolysis. Abrasive buffing is a labor intensive process that contaminates the environment, requires replacement of abrasive materials, and requires skill to avoid damaging the base. Chemical removing methods require the use of strong and costly solvents, tends to be time consuming and results in a residue that generally poses a costly disposal problem.

Pyrolysis has been defined by the Encarte Dictionary as "the process of chemically decomposing solid wastes by heat in an oxygen-reduced atmosphere. This results in a gas stream containing primarily hydrogen, methane, carbon monoxide, carbon dioxide, and various other gases and inert ash, depending on the organic characteristics of the material being pyrolysized." Pyrolysis is a relatively fast and inexpensive way to remove a surface coating, but prior art ovens tend to be hard to control and likely to damage the base.

The use of heat to thermally decompose a surface coating of paint is described in the patent art at least as early as 1922 (U.S. Pat. No. 1,416,865 granted on May 23, 1922 discloses an oven for removing enamel from fenders and the like). However, the thermal decomposition of the coating produces gases which are flammable, and burning of these gases produces heat in addition to the heat applied to the article to achieve pyrolysis. The liberation of additional heat increases the temperature within the oven tending to damage the base and creating control and smoke problems. In addition, the presence of gases from decomposition of the surface coating may produce an explosive mixture of gas and oxygen, thus increasing the likelihood of damage to the base and requiring precautions in the construction and operation of the oven.

One attempt to make an oven for burning-off the surface coating from the base is described in U.S. Pat. No. 5,351,632 granted on Oct. 4, 1984 to C. Mann in which the atmosphere within the oven is continually changed to prevent the build-up of vapors and smoke. Another approach is disclosed in U.S. Pat. No. 5,018,458 granted on May 28, 1991 to McIntyre et al. in which water is sprayed on the contents of the oven to maintain the temperature below a maximum value. Another approach has been to replace the atmosphere within the oven with an inert gas, or a vacuum (U.S. Pat. No. 4,141,373 granted on Feb. 27, 1979 to Kartanson et al.). In all of these prior art systems for removing a surface coating by pyrolysis, thermal energy is being given up for control, and in most cases equipment is added to the oven for the sole purpose of control.

While removal of coatings from a base is an important use of the present invention, the pyrolyic methods and ovens of the present invention are affective to disassociate organic materials for other purposes, such as disposal of waste materials commonly referred to as sludge, or the recovery of ingredients contained within the organic materials.

SUMMARY OF INVENTION

It is a general object of the present invention to provide an improved process for incinerating and an oven for disassociating organic materials. More particularly, it is an object of the present invention to provide a process for incinerating and an oven for removing the surface coating from the base of a manufactured article or scrap by pyrolysis under controlled conditions, more efficiently, at a lesser cost and environmentally cleaner than prior art devices. The present invention achieves these objects by providing an oven with a continuous flow of a gaseous mixture through the processing chamber of the oven that contains less oxygen than required for combustion.

For economic reasons, air from the ambient atmosphere is the gas of choice for the gaseous flow through the processing chamber of an oven. While the precise amount varies from place to place and time to time, the ambient atmosphere contains of the order of 20 percent oxygen by volume at room temperature. Studies have shown that combustion of paint requires at least about 12 percent oxygen by volume in the processing chamber of an oven at the temperature of the gases during pyrolysis.

In accordance with the present invention, a gas which is incapable of supporting combustion is mixed with ambient air to produce a mixture of gases that contains less than 12 percent oxygen by volume at the temperature required for pyrolysis, about 700 to 800 degrees Fahrenheit, and thereafter maintaining a flow of this mixture of gases through the processing chamber of the oven. For economic reasons, water vapor or steam is the preferred gas for mixing with ambient air to provide a gaseous medium which flows through the processing chamber of the oven. Additionally, water vapor has a significantly higher thermal capacity than air, and the presence of water vapor in the gas mixture within an oven provides greater heat transfer from the oven gasses to the work load than air alone.

Water is a stable compound throughout the temperature range of normal oven processes. While the chemical bonds between the hydrogen and oxygen atoms of water weaken as the temperature increases, at temperatures below 1500 degrees Celsius the decomposition is less than 0.15 percent, at 2000 degrees Celsius about 1.8 percent, and at 2700 degrees Celsius about 11.1 percent. The present invention takes advantage of this property of water by diluting the ambient air with water vapor in the form of a gas to form a mixture of gases for circulation through the oven processing chamber, thereby reducing the concentration of oxygen in the processing chamber.

The inventor has found that removal of paint or plastic coatings by pyrolysis can be accomplished without burning or an explosion in an oven containing a gaseous mixture in the processing chamber consisting of up to 60 percent air and 40 percent gas which is incapable of sustaining combustion at oven operating temperatures. Preferably, the gas in the mixture that is incapable of sustaining combustion is water vapor. The amount of water vapor in the mixture preferably does not exceed 60 percent of the mixture by volume in order to prevent the ash residue becoming a sludge which is harder to dispose of than dry ash, and to facilitate treatment of exhaust gases with a fluidized bed converter. Hence, the mixture of air and water vapor is preferably 40 to 60 percent air and 60 to 40 percent water vapor by volume.

The volume of exhaust gases discharged in a given period of time is controlled by a variable speed fan preferably disposed in the exhaust port. The volume of gases removed from the processing chamber through the exhaust port is controlled to equal the volume of the gas mixture introduced into the processing chamber plus the volume of gases evolving from the thermal disassociation of the surface coatings per unit of time. Hence, the oven operates at a relatively fixed positive or negative pressure. It is preferred that this pressure be negative to prevent leakage of gases from the processing chamber, and preferably between 0.00 and −5.0 pounds per square foot.

The inventor has found that a surface coating of commercially available paint, which is an organic material, will be removed in an oven operated according to the teachings of the present invention when exposed to a temperature between at least 650 degrees Fahrenheit and 800 degrees Fahrenheit for a period of about 90 minutes including the time required to bring the oven to operating temperature from room temperature. At a temperature of 600 degrees Fahrenheit, the paint surface coating starts to wrinkle; at about 650 degrees Fahrenheit, the coating starts to drip off of the base; at about 700 degrees Fahrenheit, the coating flows off of the base; and at 800 degrees Fahrenheit, smoke stops evolving from the coating and the article turns to a dull brownish black.

The present invention may be practiced in the form of a batch oven or as a continuous oven in which the work pieces are transported through the processing chamber on a conveyer. The present inventor's U.S. Pat. No. 5,868,565 issued Feb. 9, 1999 entitled METHOD OF HEAT TREATING ARTICLES AND OVEN THEREFOR discloses an oven that may be modified to operate as a continuous oven according to the present invention, as will be described in greater detail hereafter. In the continuous embodiment of the oven according to the present invention, air curtains or air closures are provided at the entrance and exit openings to the processing chamber. While any air curtain that reduces leakage between the processing chamber and the surrounding air to a sufficiently low level may be used, the air closures described in the present inventor's U.S. Pat. No. 4,298,341 entitled INDUSTRIAL OVEN HAVING AIR RECIRCULATION MEANS FOR MINIMIZING HEAT LOSS and U.S. Pat. No. 5,868,565, referred to above, are preferred. The air leakage through the air closures at the openings of the oven form the air component of the mixture of gases in the processing chamber. Further, water droplets are converted into steam in the air flow of the air closures to produce the gaseous mixture of air and water vapor which flows through the processing chamber in accordance with the present invention. The water vapor component of the gas flow must be at least 40 percent of the total air/water vapor mixture flowing through the processing chamber of the oven to prevent combustion of the gases from decomposition of the surface coatings. Further, the gases in the processing chamber of the oven must be at a temperature above 600 degrees Fahrenheit, and preferably between 700 and 800 degrees Fahrenheit to effectively decompose the surface coating on articles by pyrolysis.

Figure 1:
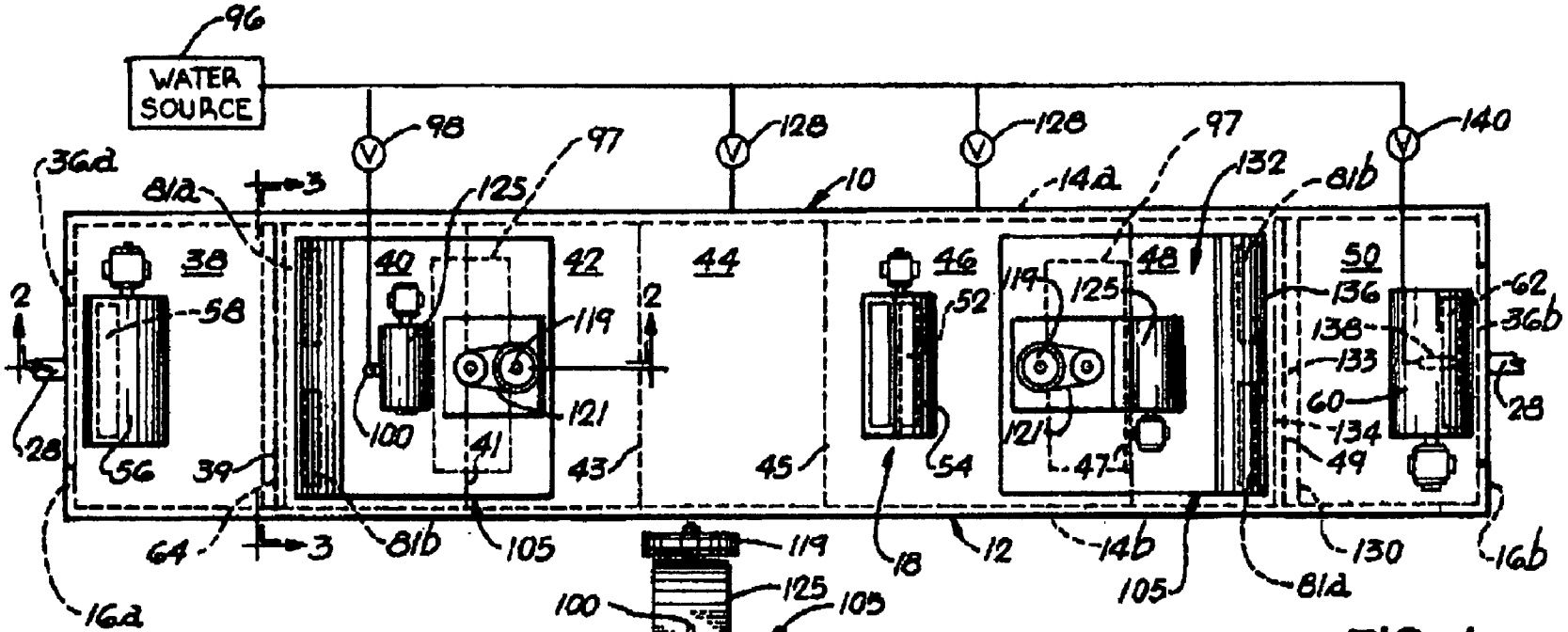
FIG. 1 is a plan view of an industrial continuous oven constructed according to the present invention.
Figure 3:
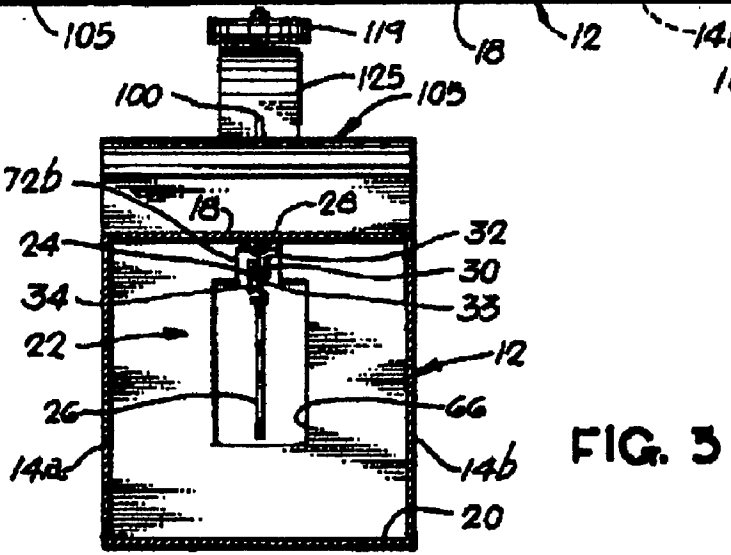
FIG. 3 is a sectional view of the oven taken along the line 3-3 of FIG. 2.
Figure 2:
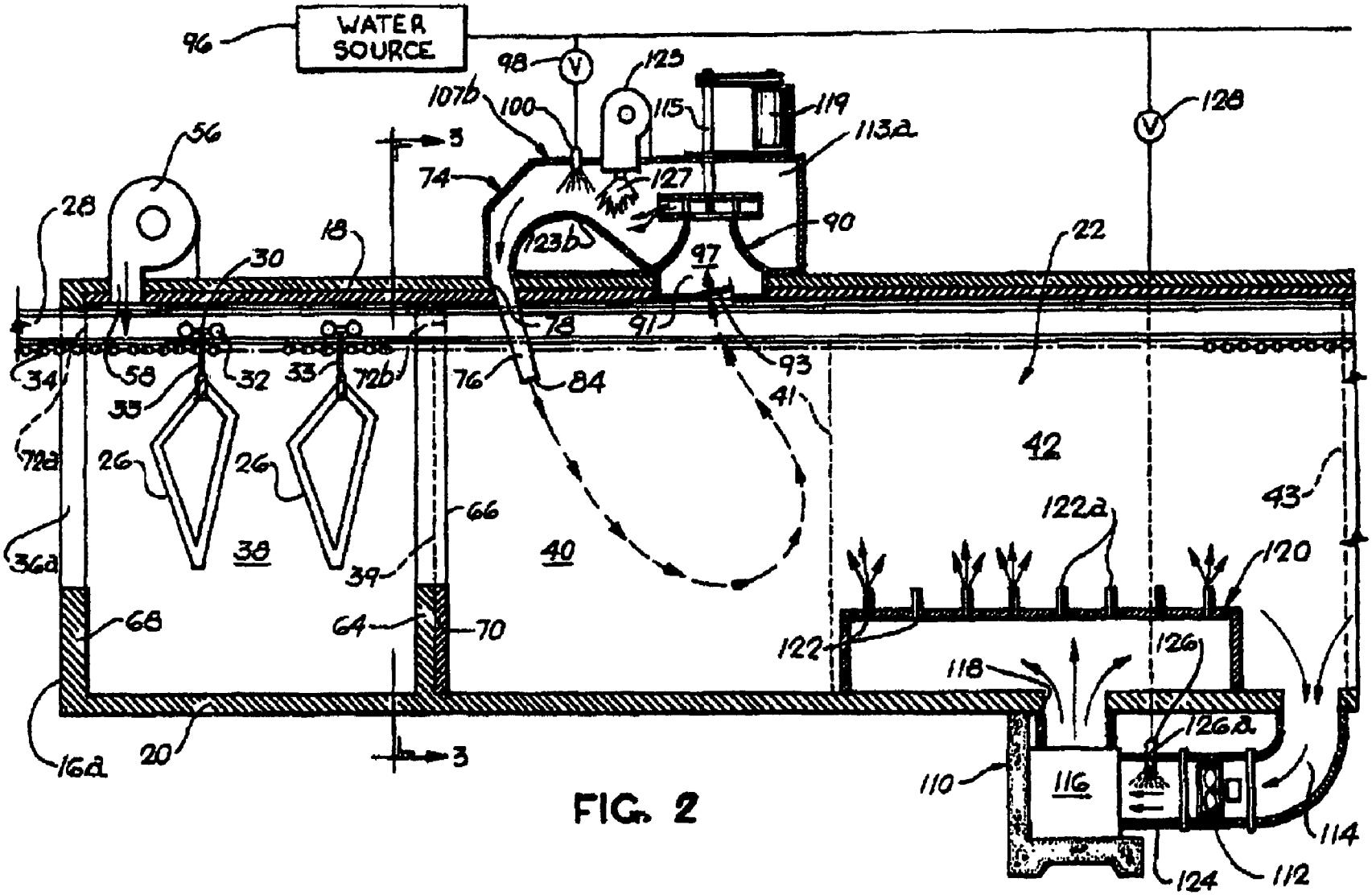
FIG. 2 is a fragmentary sectional view taken along the line 2-2 of FIG. 1, the view illustrating the entrance opening of the oven and the air seal for said opening.
Figure 5:
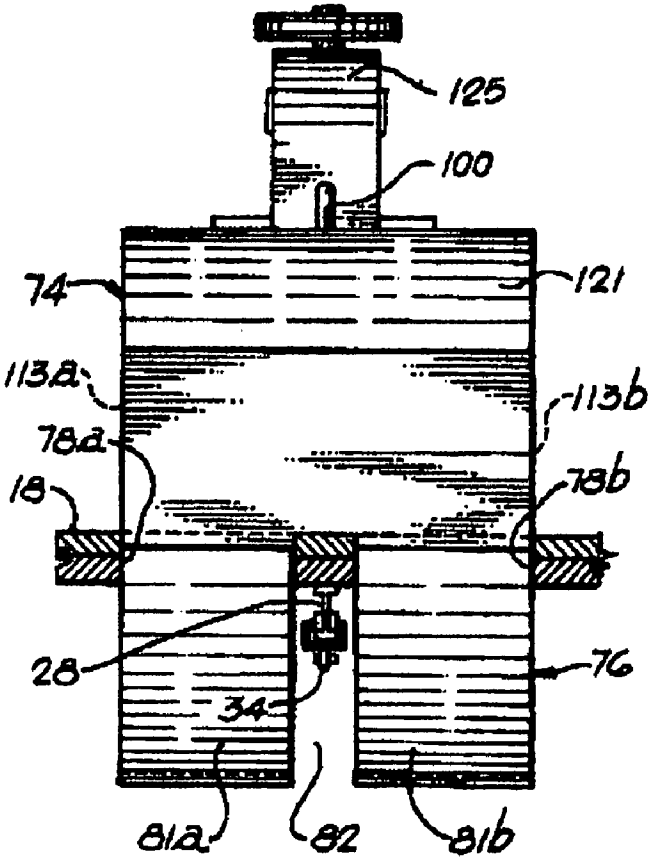
Figure 4:
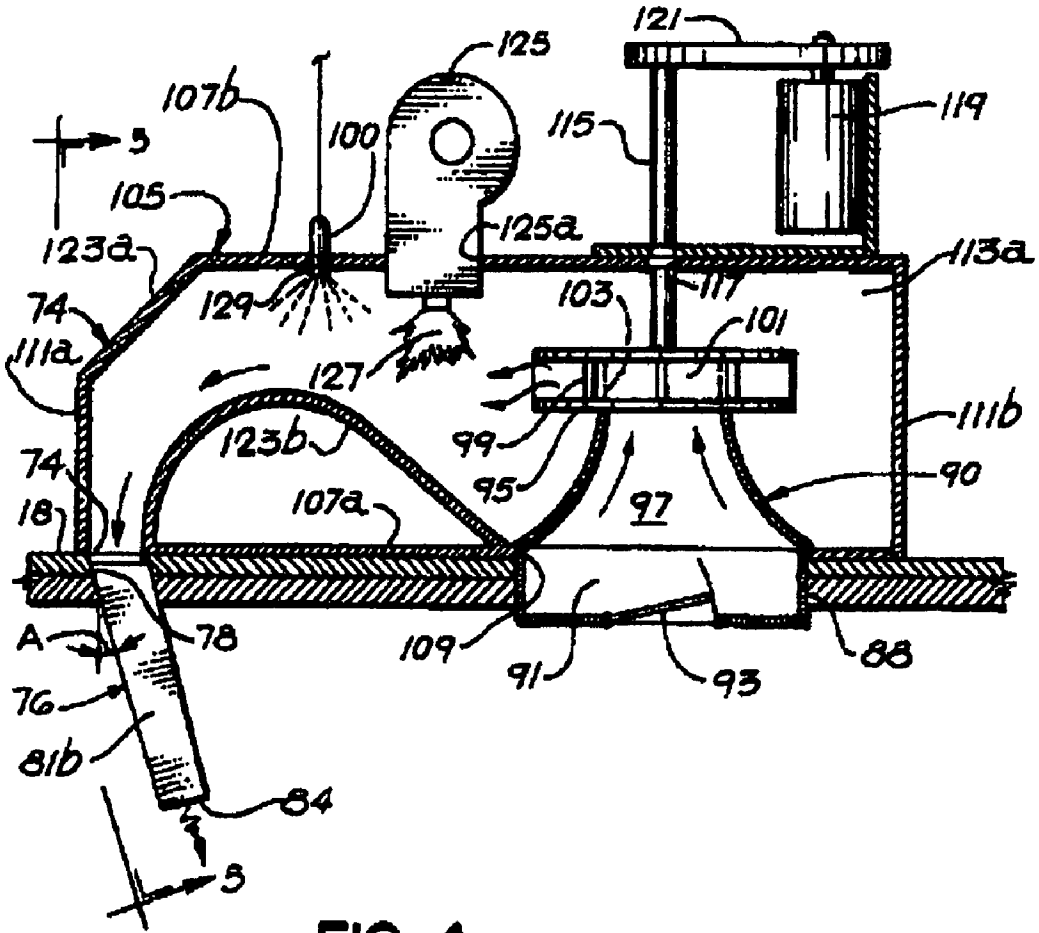
Figure 6:
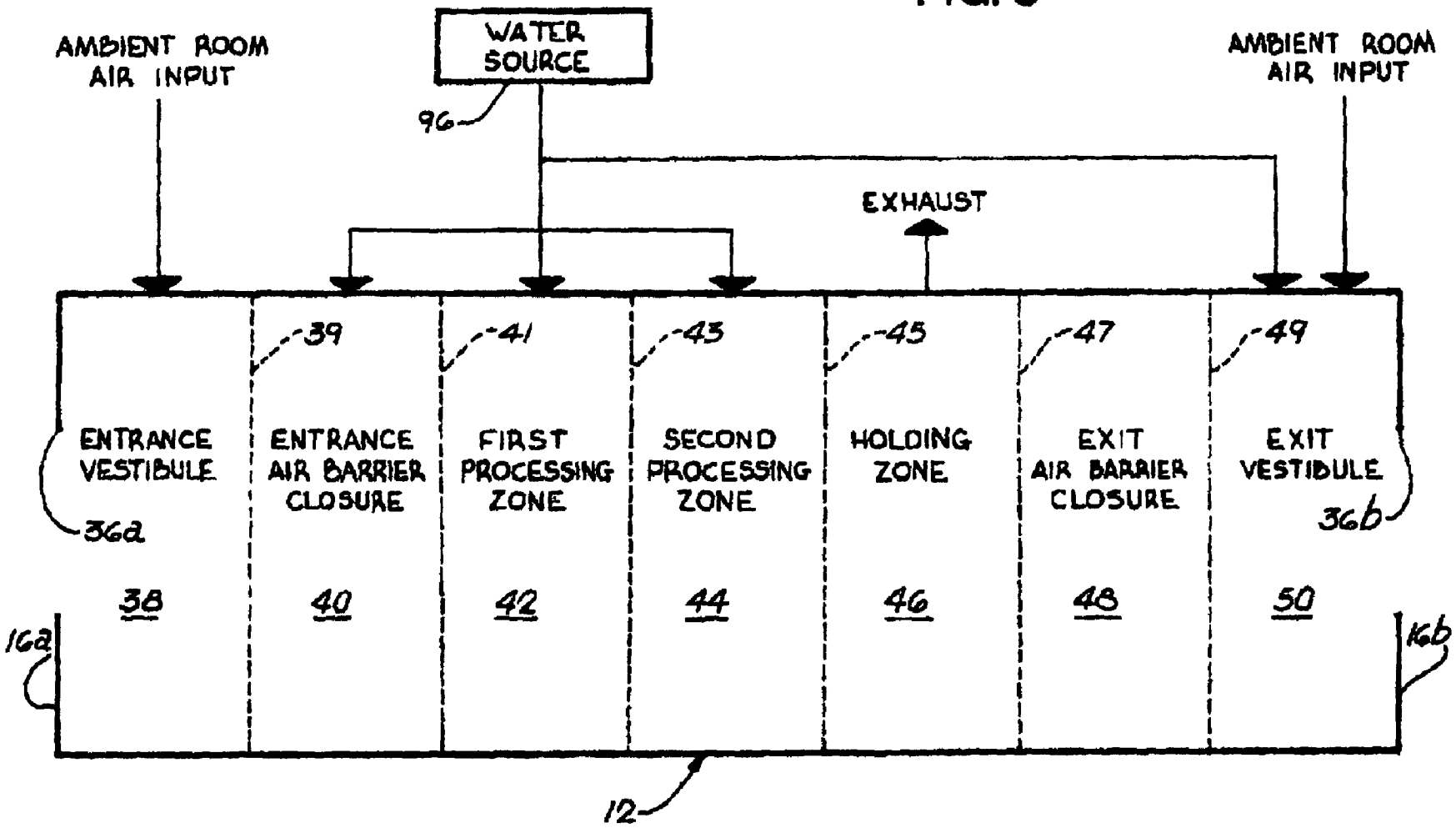
Figure 7:
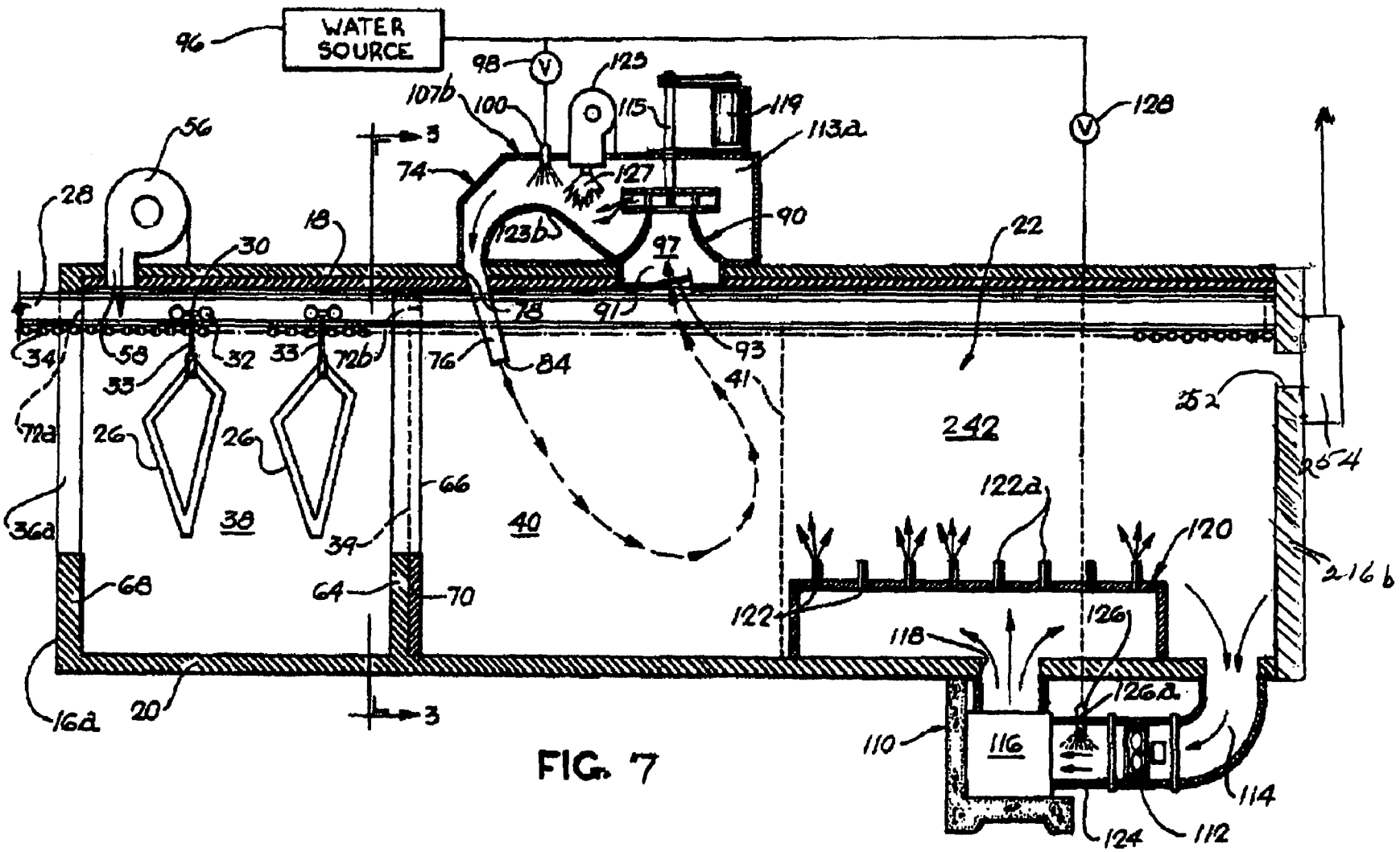

The FIG. 4 is a fragmentary sectional view of the industrial oven of FIGS. 1 through 3 illustrating in greater detail the construction of the air seal illustrated generally in FIGS. 1 through 3;

FIG. 5 is a sectional view taken along line 5-5 of FIG. 4;

FIG. 6 is a diagrammatic flow chart for the oven of FIGS. 1 through 5; and FIG. 7 is a sectional view, partly diagramatic, of a batch oven constructed according to the present invention.

DETAILED DESCRIPTION OF THE INVENTION

FIGS. 1 through 5 illustrate an oven 10 suitable for performing the pyrolysis methods which has an enclosure 12 formed by a pair of elongated side walls 14*a* and 14*b*, a pair of end walls 16*a* and 16*b*, a top wall 18 and a bottom wall 20. The walls of the enclosure 12 form an elongated linear processing chamber 22 with a rectangular cross section for receiving and treating surface coated articles 26.

The oven 10 is provided with a conveyor 24 to carry a continuous series of articles 26 into and through the elongated chamber 22. The conveyor 24 has an elongated rail 28 which extends through the chamber 22 and is mounted centrally on the underside of the top wall 18 of the enclosure 12. The rail 28 is disposed perpendicular to the end walls 16*a* and 16*b*, and supports a series of carriages 30 spaced apart along the rail. Each carriage 30 is mounted on the rail 28 on rollers 32 which are adapted to roll along the rail 28. Each carriage 30 includes a depending hanger 33 for removably mounting one of the articles 26 to be processed in the chamber 22.

The conveyer 24 is also provided with a continuous chain 34 which is disposed beneath the rail 28 and is attached to each of the carriages 30. The chain 34 is driven by a motor, not shown, and advances the carriages 30 along the elongated rail 28 at a fixed speed to transport the process articles through the elongated chamber 22.

The end wall 16*a* of the enclosure 12 is provided with an entrance opening 36*a* and the end wall 16*b* is provided with an exit opening 36*b*. The conveyor 24 carries the process article through the entrance opening 36*a*, through the elongated chamber 22 and through the exit opening 36*b*. As illustrated in FIGS. 1 and 6 the elongated chamber 22 is divided into seven different sections designated 38, 40, 42, 44, 46, 48 and 50, each section being capable of maintaining different operating conditions. It is to be understood that the chamber 22 of the oven 10 could be divided into more or less sections depending upon the operating conditions desired in different portions of the chamber 22.

As best illustrated in FIG. 2, section 38, which may be referred to as the entrance vestibule, includes end wall 16*a* and the entrance opening 36*a*. The entrance vestibule 38 has a common interface 39 with section 40, which is referred to as the entrance air seal closure, and the entrance air seal closure 40 has a common interface 41 with section 42 designated the first processing zone. In like manner, the first processing zone 42 has a common interface 43 with the second processing zone 44, and processing zone 44 has a common interface 45 with holding zone 46. Also, holding zone 46 has a common interface 47 with an exit air seal closure 48, and the exit air seal closure 48 has a common interface 49 with section 50, which is designated the exit vestibule.

Industrial ovens are required by government regulations to have a positive exhaust from the processing chamber of the oven to prevent buildup of flammable vapor within the oven. As illustrated in FIG. 1, the oven 10 provides an exhaust port 52 in the top wall 18 of the enclosure 12, and the port extends into the holding zone 46. An exhaust fan 54 is mounted on the exterior surface of the top wall 18, and the fan 54 is connected to the opening 52 and assures removal of the required portion of the gaseous environment from the chamber 22 of the oven 10, thus providing a gas pressure within the oven which is less than the external ambient gas pressure. The exhausted gases from the fan 54 are discharged through a fluidized bed and chimney, not shown, to the atmosphere.

The exhaust gases from the oven 10 are partially replaced by a mixture of ambient air and water vapor which enters the chamber 22 through four paths. A first flow of air from the ambient atmosphere is introduced through a fan 56 and port 58 into the entrance vestibule 38, and a second flow of ambient atmosphere is introduced into the exit vestibule 50 through a fan 60 and port 62. The third and fourth paths for makeup air utilize leakage through the entrance opening 36*a* and exit opening 36*b*. About one third of the makeup air enters the chamber 22 through the entrance opening 36*a* and exit opening 36*b*, and one third of the makeup air enters through each of the fans 56 and 60 into the entrance vestibule 38 and exit vestibule 50, respectively. All makeup air enters into the first processing zone and holding zone through leakage of the air seal closures 40 and 48.

The entrance vestibule 38 extends between the end wall 16*a* and a first interior wall 64 which is disposed vertically on the interface 39 between the entrance vestibule 38 and the entrance air seal closure 40. The first interior wall 64 is parallel to the end wall 16*a* and perpendicular to the longitudinal axis of the enclosure 12. The first interior wall 64 has an opening 66 which confronts the opening 36*a* in the end wall 16*a* and is the same size and shape as the opening 36*a*. The opening 36*a* in the end wall 16*a* does not extend to the bottom wall 20 of the enclosure 12, thus providing a base portion 68 between the bottom wall 20 and the opening 36*a* which functions as a weir to retard any flow of air through the opening 36*a* from the entrance vestibule 38. In like manner, the opening 66 in the first interior wall 64 does not extend to the bottom wall 20 of the enclosure 12, thus providing a base portion 70 between the bottom wall 20 and the opening 66 which functions as a weir to retard any flow of air through the opening 66 from the entrance air seal closure 40.

The openings 36*a* and 66 are made as small as possible but sufficiently large to permit ingress of the process articles on the conveyor 24. Both openings 36*a* and 66 are rectangular except for slots 72*a* and 72*b* located centrally of the upper sides of the openings 36*a* and 66, respectively, and the conveyor rail 28 extends through slots 72*a* and 72*b*. The longitudinal axes of the openings 36*a* and 66 extend from the base portions 68 and 70 to the upper side of the openings 36*a* and 66, respectively, as illustrated in FIG. 3. The inventor has found that the distance between the end wall 16*a* and the first interior wall 64 must be at least one-half and preferably three-quarters of the height of the opening 66 in the first interior wall 64 to be effective in reducing leakage of gases from the interior of the chamber 22 of the oven 10 to the surrounding atmosphere.

In addition to being a conduit for the makeup air for the oven 10, the entrance vestibule 38 and exit vestibule 50 are for the purpose of reducing leakage of the interior gases of the oven into the surrounding atmosphere, and to provide a safety zone to protect personnel from the high temperature conditions within the entrance air seal closure 40 and exit air seal closure 48 of the oven. The makeup air entering the entrance vestibule 38 is at the temperature of the air surrounding the oven, and hence significantly lower in temperature than any leakage gases from the air seal zone 40 of the oven. The makeup air will mix with any such leakage gases, thus lowering the temperature of the leakage gases, and causing the mixture of leakage gases and makeup air to fall and flow together through the opening 66 into the interior of the oven, thus reducing the gases that escape from the interior zones 42, 44, and 46 of the oven.

The entrance air seal closure 40 will be effective to reduce the leakage of the interior gases from the interior zones 42, 44, and 46 if the base portion 70 of the first interior wall 64 is omitted and the opening 66 extends to the bottom wall 20 of the enclosure 12, but not as effective as a construction in which the base portion 70 extends upwardly a substantial distance, preferably about two feet. Also, the entrance vestibule 38 will be effective to reduce the leakage of the interior gases from the interior of the chamber 22 if the base portion 68 of the end wall 16*a* is omitted and the opening 66 extends to the bottom wall 20 of the enclosure 12, but not as effective as a construction in which the base portion 68 extends upwardly a substantial distance, preferably about two feet. The entrance vestibule 38 is also effective in reducing the leakage of the gases from the entrance air seal closure 40 to the ambient atmosphere even if the end wall 16*a*, or the first interior wall 64, or both walls 16*a* and 64, are omitted from the oven construction.

The entrance air seal closure 40 contains an air seal 74 for substantially sealing the opening 66 in the first interior wall 64 against the flow of gases from zones 42, 44 and 46 of the chamber 22. The air seal 74 has a nozzle 76 which extends through, and is sealed within, the edges of an elongated slot 78 in the top wall 18 of the enclosure 12 parallel to and adjacent to the inner side of the first interior wall 64 to communicate with the chamber 22. The nozzle 76 has depending end portions 81*a* and 81*b* which are spaced from each other to form a slot 82 which accommodates the rail 28. Each of the end portions has an elongated aperture 84 confronting and communicating with the interior of the chamber 22.

The depending end portions 81*a* and 81*b* are disposed on a common plane, and the plane 86 is disposed at an included angle, designated A, of about 15 to about 45 degrees to the plane of the interior wall 64. A supply of gases for the nozzle 76 from the environment of the chamber 22 is provided by a port 88 which extends through the top wall 18. The port 88 is disposed in the top wall 18 spaced from the nozzle 76 toward the interface 41 between the entrance air seal closure 40 and the first processing zone 42. The port 88 accommodates a plug blower 90 mounted on the top wall 18. The blower 90 has a circular damper assembly 91 which confronts the chamber 22 of the enclosure 12, and the damper assembly 91 has a pivotally adjustable damper plate 93 for controlling the flow of gaseous medium from the chamber 22. The blower 90 also has a distributor ring 95 mounted in a fixed position by a generally truncated conical guide 97 which is mounted between the distributor ring 95 and the damper assembly 91. The distributor ring 95 is provided with radially disposed veins 99 forming passages 101 for the flow of gases, and a squirrel cage rotor 103 is rotatably and coaxially mounted within the distributor ring 95.

The blower 90 is coupled to the inlet end 94 of the nozzle 76 by a generally rectangular air-tight heater box 105 mounted on the top wall 18 of the enclosure 12 about the plug blower 90. The heater box 105 has a bottom wall 107*a* mounted on the top wall 18 of the enclosure 12, and the bottom wall is provided with an opening 109 which accommodates the damper assembly 91. The heater box 105 has a top wall 107*b* spaced from and parallel to the bottom wall 107*a*. A front wall 11*a*, back wall 111*b*, and a pair of opposing side walls 113*a* and 113*b* complete the heater box 105.

The squirrel cage rotor 103 has a shaft 115 which extends vertically from the blower unit 90 through an aperture and bearing assembly 117 in the top wall 107*b* of the heater box 105, and the shaft 115 is coupled to a motor 119 by a belt and pulley assembly 121 mounted on the shaft 115. The motor 119 rotates the rotor 103 within the distributor ring 95, thus expelling the gases flowing into the blower 90 through the damper assembly 91, through the passages 101 of the distributor ring 95, and into the interior of the heater box 105. The heater box 105 acts as a duct for directing the flow of gases from the blower 90 to the slots 78*a* and 78*b*, and hence to the depending portion 81*a* and 81*b* of nozzle 76. To facilitate the flow, the heater box 105 has a flat strip 123*a* extending between the top wall 107*b* and the front wall 111*a*, and a curved deflector 123*b* confronting the bottom wall 107*a* between the slots 78*a*, 78*b* and the opening 109 for the blower unit 90.

A direct fire burner 125 is mounted in an opening 125*a* located centrally in the top wall 107*b* of the heater box 105 between the blower 90 and the front wall 111*a*, and the burner 125 produces a flame illustrated at 127 within the heater box 105 for the purpose of heating the gases flowing through the nozzle 76 to a temperature of at least 300 degrees Fahrenheit and preferably 600 to 800 degrees Fahrenheit. The burner 125 is preferably operated on gas or oil from a source not shown, and the burner 125 is provided with a flow of air to support the burner combustion from the ambient atmosphere. The exhaust of the burner 125 becomes a part of the environment within the chamber 22 of the oven.

A spray nozzle 100 is mounted in an aperture 129 in a central portion of the top wall 107*b* of the heater box 105 between the burner 125 and the front wall 111*a* of the heater box 105, and the spray nozzle 100 is connected to the source of water 96 to introduce the necessary moisture into the entrance air seal closure 40.

The stream of air and gases from the nozzle 76 should have a velocity sufficient to prevent excessive leakage of gases from the entrance air seal closure 40 into the entrance vestibule 38 and to function as a carrier to introduce sufficient water vapor into the chamber 22, from all sources to reduce the oxygen in the chamber to a level below that required to support combustion. The inventor has achieved good results with a velocity of about 900 feet per minute for each foot of height of the opening 66 in the first interior wall 64.

As stated above, the operating temperature of the chamber 22 for thermally disassociating a paint or plastic surface coating from a base must be between 600 to 700 degrees Fahrenheit, and the temperature of the mixture of air and gases from the nozzle is preferably between 450 and 600 degrees Fahrenheit. This temperature is sufficient to flash the water vapor from the nozzle 100 to gas and to carry sufficient water vapor into the chamber 22 to prevent combustion.

A source of pressurized water 96, which may be a municipal water supply, is coupled to the heater box 105 through a valve 98 and the spray nozzle 100. When the valve 98 is opened, water flows through the valve and the spray nozzle 100 and enters the chamber of the heater box 105 as a mist. Since the temperature of the heater box 105 is well above the boiling point of water, the water flashes into steam at the temperature of the interior of the heater box. This super heated steam is mixed with the gases from chamber 22 and then the mixture is forced into the chamber 22 through the nozzle 76.

As illustrated in FIGS. 1 and 5, the oven 10 has a first processing zone 42 and a second processing zone 44 for heat treating the process articles 26. An oven constructed in accordance with the present invention may have only a single processing zone, or more than the two processing zones illustrated, and the processing zones may have identical constructions or be different, depending upon the requirements for the particular oven. In the particular embodiment of the invention described, these processing zones 42 and 44 are identical in construction, and only the first processing zone 42 will be described in detail. The first and second processing zones 42 and 44 are operated in the same manor in the present oven.

The first processing zone 42 extends between the interface 41 with the air seal closure 40 and the interface 43 with the second processing zone 44. The processing zone 42 contains a heating system 110 which is provided with a blower 112 which draws the gaseous environment from the chamber 22 through a return duct 114 in the bottom wall 20 of the enclosure 12. The blower 112 then forces the gases through a furnace or heat exchanger 116, and the heated gases are then returned to the chamber 22 through a port 118 in the bottom wall 20 of the enclosure 12 and an elongated distribution manifold 120 disposed within the enclosure 12 on the bottom wall 20 parallel to the axis of elongation of the enclosure 12. The manifold 120 has a plurality of spaced apertures 122 disposed along the axis of elongation of the manifold 120, and a short hollow stub 122*a* is mounted in each aperture and extends from the manifold to distribute the heated gases within the chamber 22.

A coupler 124 is connected between the blower 112 and the heater 116, and a spray nozzle 126 is mounted in an aperture 126*a* in the coupler. The spray nozzle 126 is connected to the source of water 96 through a valve 128, and the spray nozzle delivers a spray of water into the gases entering the heater 116 to produce super heated steam within the chamber 22 of the first processing zone 42.

The second processing zone 44 extends from the interface 43 with the first processing zone 42 to the interface 45 with the holding zone 46, and the second processing zone is constructed in the same manner as the first processing zone 42 and operated as described above.

The oven 10 is designed to bring the process article up to the temperature required for pyrolysis, and if the total heat required to increase the temperature of the process articles 26 to the processing temperature can be transferred from the environment of the chamber 22 in the single processing zone 42, no additional processing zones are required. However, if the amount of heat which must be acquired by a process article to raise its temperature to the desired pyrolysis treating temperature exceeds the maximum quantity of heat that the first processing zone can produce and transfer to the process article during the period the process article resides in that zone, more than a single processing zone must be utilized.

The holding zone 46 extends from the interface 45 with the second processing zone 44 to the interface 47 with the exit air seal closure 48. The holding zone 46 is constructed in the same manner as the first processing zone 42 with two important exceptions, and the identical portions of the holding zone 46 will not be further described or illustrated. The first exception is that the holding zone is designed to provide the desired residence time at the desired processing temperature for the process articles, and accordingly, the length of the channel 22 within the holding zone 46 is much longer than the length of the channel 22 within the first processing zone 42. The second exception is that the exhaust port 52 is located in the top wall 18 of the enclosure 12 centrally between the interfaces 45 and 49 and centrally between the side walls 14*a* and 14*b*.

The exit air seal closure 48 extends between the interface 47 with the holding zone 46 and the interface 49 with the exit vestibule 50, and the air seal closure 48 is identical in construction to the entrance air seal closure 40 with the exceptions that construction of the exit air seal closure 48 is reversed in direction to seal against the air and gases of the channel 22 escaping from the channel 22 through the exit vestibule 50 and the exit opening 36*b*, and the water spray nozzle 100 is omitted from the exit air seal closure.

More specifically, the exit air seal closure 48 has a second internal wall 130 disposed on the interface 49 between the exit air seal closure and the exit vestibule 50, the second internal wall being identical to the first internal wall 64. The exit air seal closure 48 contains an air seal 132 for substantially sealing the opening 133 in the second internal wall 130 against the flow of gases from zones 42, 44 and 46 of the chamber 22. The air seal 132 has a nozzle 134 which extends through and is sealed within the edges of an elongated slot 136 in the top wall 18 of the enclosure 12 parallel to and adjacent to the inner side of the second internal wall 130 to communicate with the chamber 22. The nozzle 134, and other portions of the exit air seal closure 48, are identical to the nozzle 76, and other portions of the entrance air seal closure 40, and will not be further described.

The exit vestibule 50 is substantially identical to the entrance vestibule with two exceptions. The first exception is that the exit vestibule 50 is located between the interface 49 with the exit air seal closure 48 and the end wall 16*b*, and the port 62 for introducing makeup air into the exit vestibule 50 is disposed adjacent to the end wall 16*b*. The second exception is that a spray nozzle 138 is mounted on the fan 60 confronting the port 62 and connected to the water source 96 through a valve 140 to spray a limited quantity of water into the makeup air being injected into the exit vestibule.

In one particular construction of an oven as set forth above, the oven was designed to process metal bases with paint surface coatings weighing 100 pounds each disposed at intervals of 7.5 feet on the conveyor 24 at a rate of 176 articles per hour. Temperature within the tunnel is maintained at between 700 and 800 degrees Fahrenheit, and each article remains subjected to this temperature for a period of time of about 30 minutes. The conveyor speed is 11 feet per minute.

The entrance opening 36*a*, the exit opening 36*b*, the opening 66 in the first interior wall and the opening in the second interior wall 130 have heights of 8.0 feet and widths of 6.0 feet, and the openings are disposed upwardly of base portions 68 of 2.0 feet. The entrance and exit vestibules 38 and 50 are 8.0 feet in length. The entrance air seal closure 40 and the exit air seal closure 48 have lengths of 24.0 feet and 12.0 feet, respectively. The first processing zone 42 and the second processing zone 44 are each 44.0 feet long, and the holding zone 46 is 330.0 feet in length. All measurements referred to above are taken along the axis of elongation of the channel 22.

In this construction, the exhaust fan 54 pumps about 7789 cubic feet of air per minute at a temperature of about 750 degrees Fahrenheit from the holding zone 46, thus assuring that volatile gas vapor and free oxygen will be maintained at a safe levels within the oven chamber 22. About 2400 cubic feet of air per minute at room temperature of about 70 degrees Fahrenheit is pumped into the entrance vestibule 38 through the fan 56, and about 2400 cubic feet per minute of air at about 70 degrees Fahrenheit is pumped into the exit vestibule 50 through the fan 60. Since the combined makeup air volume is 4800 cubic feet per minute, far less than the exhaust from the holding zone 46, a lower pressure will result in the air closures 40 and 48, processing zones 42 and 44, and holding zone 46, thus resulting in an inflow of ambient air through the openings 36*a* and 36*b*. As a result, it is less likely that the environment of the air closures 40 and 48, processing zones 42 and 44, and holding zone 46, will escape into the surrounding atmosphere.

In operation, 100 pound metal articles with surfaces covered with paint enter the entrance opening 36*a* at a temperature of about 70 degrees Fahrenheit and enter the air closure 40 at about the same temperature. The entrance air closure 40 is subjected to a flow of 10,757 cubic feet of air and vapor from the nozzle 76 at a temperature of 600 degrees Fahrenheit and about 9.0 gallons of water per minute is in the flow in the form of super heated steam, thus heating the article to about 100 degrees when it leaves the entrance air closure 40. Processing zones 42 and 44 are maintained at about 750-800 degrees Fahrenheit, and the article temperature rises to about 400 degrees Fahrenheit in the first processing zone 42 and to a temperature of about 750 degrees Fahrenheit in the second processing zone 44. Each of these processing zones 42 and 44 also receives 9.0 gallons of water per minute injected into the heating systems thereof. The holding zone 46 is also maintained at a temperature of about 750-800 degrees Fahrenheit by its heater, and no water is injected into the holding zone. About 7789 cubic feet of exhaust gases per minute are removed from the holding zone and conveyed to the ambient atmosphere.

The exit air closure 48 receives the articles from the holding zone at about 700 degrees Fahrenheit. The nozzle of the exit air closure receives about 5378 cubic feet of air and vapor per minute at a temperature of about 600 degrees Fahrenheit to maintain the temperature within the holding zone at its desired value to the interface with the exit air closure. The exit vestibule 50 receives the articles at about 400 degrees Fahrenheit and cools the articles to about 350 degrees Fahrenheit at the exit opening 36*b*. The exit vestibule 50 is provided with about 2400 cubic feet per minute of air at about 70 degrees Fahrenheit and 2.8 gallons per minute of water vapor through the exit vestibule fan. The temperature of the exit vestibule is about 200 degrees Fahrenheit.

An example of a batch oven for practicing the present invention is illustrated in FIG. 7. This batch oven is designed to receive successive batches for processing with limited cooling off periods for the oven between batches to permit removal of the processed batch and loading of the subsequent batch into the oven.

The batch oven of FIG. 7 is provided with an entrance vestibule, and entrance air seal closure identical to the entrance vestibule 38 and air seal closure 40 of the oven described in FIGS. 1 through 6, except for dimensions, and these sections, and other substantially identical portions, of the batch oven of FIG. 7 are illustrated bearing the same reference numbers.

The batch oven has a single processing zone 242 which communicates with the entrance air seal closure at the common interface 41. The processing zone 242 has a heating system 110 identical to the heating system 110 of the first processing zone of the embodiment of FIGS. 1 through 6, and the heating system of FIG. 7 is illustrated with identical reference numbers and will not be further described.

The oven has an enclosure 12 which forms an elongated chamber 22. The chamber 22 extends through the entrance vestibule 38, entrance air seal closure 40 and processing zone 242 to an end wall 216*b* which seals the end of the elongated enclosure 12 against air leakage. An exhaust port 252 extends through the end wall 216*b*, and a blower 254 is mounted at the port and communicates with the ambient atmosphere to remove gasses from the processing chamber 242. Similar to the embodiment of FIGS. 1 through 6, ambient air enters into the elongated channel 22 as leakage through the opening 36*a* in the entrance vestibule 38 and this flow of ambient air is mixed with water vapor that is injected as water drops in the entrance air seal closure 40. The mixture of air and water vapor flows through the processing chamber 242 and becomes mixed with gases evolving from decomposition of any organic mass being processed, and thereafter is drawn out of the exhaust port 252 by the blower 254. In accordance with the present invention, water vapor constitutes at least 40 percent of the mixture of ambient air and water vapor within the processing channel 22.

In a preferred construction of a batch oven as illustrated in FIG. 7, the processing channel is 9 feet wide, 10 feet high and 15 feet long. The entrance openings 36*a* and 66 are 6 feet wide and 5 feet high, and the base portions 68 and 70 are 1 foot high. The nozzle 76 of the entrance air seal closure 40 delivers a flow of gases at a rate of about 4000 cubic feet per minute at a temperature of about 450 degrees Fahrenheit. The processing zone 242 is operated at a temperature of 800 degrees Fahrenheit, and about 2400 cubic feet of gases per minute are exhausted through the port 252.

In practice, it is preferred to place a batch of articles to be processed, such as organic coated steel articles, in the processing chamber 242 with the temperature of the processing chamber about 350 to about 450 degrees, and maintain the process items at this temperature for a period of 20 minutes to complete curing of the organic paint or other material or begin the process of decomposing the organic material. Thereafter, the temperature of the gases in the processing chamber 242 is raised to a temperature of 600 to 800 degrees Fahrenheit to pyrolysis the organic materials of the process articles. The temperature is maintained at 800 degrees Fahrenheit for one hour. Thereafter, the temperature of the processing chamber and energy input is monitored, and a decrease in temperature or an increase in energy consumption will indicate the completion of the pyrolysis process. Completion of the pyrolysis process is generally detected within a period of about 20 minutes. The temperature of the processing chamber 242 is then lowered to about 400 degrees Fahrenheit and the flow of water to the burners 75 and 110 is cut off by closing the valves 98 and 128. Cooling is generally accomplished within about 10 minutes. The process articles are then removed from the oven on the conveyor, and the oven is ready to receive the next batch.

The present invention may be practiced in a batch oven that is not provided with an entrance vestibule or an entrance air seal closure, but merely uses a hinged or sliding door, or other closure device, to isolate the interior of the oven from the ambient atmosphere. Such a construction must provide an opening in the door or the enclosure to permit a flow of ambient air to enter the processing chamber and form a mixture of air and at least 40 percent water vapor. However, a batch oven constructed in the manner of FIG. 7 has the advantage over such a simplified construction in that it provides much faster unloading and loading of the batch oven. The vestibule also provides safety for the personnel working near the oven, since it isolates them from the high temperatures required for pyrolysis.

Those skilled in the art will perceive of many applications of the present invention in addition to those specifically set forth, and also many structures in addition to those disclosed for practicing the present invention. It is therefore intended that the present invention be not limited by the foregoing disclosure, but only by the appended claims.

The invention claimed is:

1. A method of thermally disassociating a mass of organic material comprising providing a processing chamber with an exhaust port between the ambient atmosphere and the atmosphere within the processing chamber, and an opening between the ambient atmosphere and the atmosphere within the processing chamber, the opening being of sufficient size to pass the organic mass between the ambient atmosphere and the atmosphere within the processing chamber, continuously flowing water vapor into the gaseous atmosphere within the processing chamber, continuously withdrawing a flow from the gaseous atmosphere within the processing chamber through the exhaust port to maintain the pressure in the processing chamber at a pressure no greater than the ambient atmosphere, thereby providing a flow of ambient air through the opening into the processing chamber, the combined flow of water vapor and ambient air into the processing chamber containing 40 to 60 percent water vapor and ambient air by volume, whereby the combined flow of air and water vapor into the processing chamber contains insufficient oxygen to maintain combustion, heating the gaseous atmosphere within the processing chamber to a temperature between 650 degrees Fahrenheit and 800 degrees Fahrenheit, transporting the organic mass from outside of the processing chamber through the opening and into the processing chamber, whereby the organic mass contacts the gaseous atmosphere within the processing chamber, and maintaining the organic mass in contact with the gaseous atmosphere within the processing chamber for a sufficient period to disassociate the organic mass into gases, smoke and solid residue without combustion.

2. The method of thermally disassociating a mass of organic material comprising claim 1 wherein the processing chamber is maintained at temperatures between 700 and 800 degrees Fahrenheit including the step of retarding the flow of air through the opening with an air barrier.

3. A method of thermally disassociating an organic mass comprising the steps of providing an enclosure with an elongated tunnel with air impermeable walls and a gaseous atmosphere, the tunnel having an opening at one end thereof and an exhaust port, continuously exhausting a portion of the atmosphere within the tunnel through the exhaust port to maintain the pressure of the atmosphere within the tunnel at a pressure no greater than that of the ambient atmosphere, providing a continuous flow of a gaseous medium across the opening in the enclosure to partially seal the opening against leakage through the opening, thereby providing a continuous limited flow of ambient air through the opening and into the tunnel, continuously flowing water vapor into the atmosphere within the tunnel to produce a combined flow with said flow of ambient air with at least 40 percent water vapor by volume and no more than 60 percent air by volume, whereby the mixture of air and water vapor in the combined flow contains insufficient oxygen to support combustion, heating the atmosphere in the tunnel to a temperature between 650 degrees Fahrenheit and 800 degrees Fahrenheit and maintaining the temperature of said atmosphere at a temperature in said temperature range for a period sufficient to process the organic mass, transporting the organic mass through the opening in the tunnel into contact with the atmosphere in the tunnel, whereby the organic mass undergoes an endothermic reaction and retaining the organic mass in the tunnel for a sufficient period of time to disassociate the organic mass.

4. The method of thermally disassociating an organic mass comprising the steps of claim 3 and heating the flow of gaseous medium across the opening to a temperature between 250 and 600 degrees Fahrenheit.

5. The method of thermally disassociating an organic mass comprising the steps of claim 4 wherein the step of introducing water vapor into the atmosphere within the tunnel injects water into the flow of heated gaseous medium across the opening to produce steam within the flow.

6. The method of thermally disassociating an organic mass comprising the steps of claim 4 wherein the temperature within the tunnel of the enclosure is maintained at temperatures of about 700 to 800 degrees Fahrenheit and the temperature of the flow of gaseous medium across the opening is at a temperature of 400 to 600 degrees Fahrenheit.

7. The method of thermally disassociating an organic mass comprising the steps of claim 3 wherein a plurality of organic masses are removably mounted at spaced intervals on a conveyor which extends through the opening and into the tunnel, the conveyor extending through the tunnel of the enclosure and out of the enclosure through a second opening, transporting the articles on the conveyor through the tunnel and out of the enclosure, and providing within the tunnel a flow of a gaseous medium across the second opening to reduce leakage from the tunnel through the second opening in the enclosure.

8. A method of thermally disassociating an organic surface coating from an article comprising the steps of heating the gaseous atmosphere in an elongated tunnel in an enclosure and maintaining the temperature of said atmosphere at a temperature of at least 650 degrees Fahrenheit, transporting the article through an opening in the enclosure into the tunnel, providing within the tunnel a continuous flow of a gaseous medium across the opening to reduce leakage of gases through the opening in the enclosure, continuously exhausting a portion of the gaseous atmosphere within the tunnel to maintain the pressure of the gaseous atmosphere within the tunnel below that of the ambient atmosphere, thereby producing a continuous flow of air through the opening into the tunnel, and continuously flowing water vapor into the atmosphere within the tunnel to produce an air and water vapor mixture of at least 40 percent water vapor by volume.

9. A method of thermally disassociating an organic mass comprising the steps of heating the atmosphere in an elongated tunnel disposed within an enclosure provided with air impermeable walls and an opening and an exhaust port to a temperature of at least 650 degrees Fahrenheit and maintaining the temperature of the atmosphere in said tunnel above said 650 degrees Fahrenheit, transporting the organic mass through the opening in the enclosure into the tunnel and retaining the organic mass in the tunnel for a sufficient period of time to disassociate the mass, providing a continuous flow of a gaseous medium across the opening in the enclosure to partially seal the opening against leakage through the opening, continuously exhausting a portion of the atmosphere within the tunnel to maintain the pressure of the atmosphere within the tunnel at a pressure below that of the ambient atmosphere, thereby providing a continuous limited flow of ambient air through the opening and into the tunnel, continuously flowing water vapor into the atmosphere within the tunnel to produce an ambient air and water vapor mixture of at least 40 percent water vapor by volume, whereby the mixture of ambient air and water vapor continuously flows through the processing chamber during the processing of the organic mass reducing the quantity of oxygen available to react with the organic mass.

10. The method of thermally disassociating an organic mass comprising the steps of claim 9 and heating the flow of gaseous medium across the opening to a temperature between 250 and 600 degrees Fahrenheit.

11. The method of thermally disassociating an organic mass comprising the steps of claim 10 wherein the step of continuously flowing water vapor into the atmosphere within the tunnel injects water into the flow of heated gaseous medium across the opening to produce steam within the flow.

12. The method of thermally disassociating an organic mass comprising the steps of claim 10 wherein the temperature within the tunnel of the enclosure is maintained at temperatures of about 700 to 800 degrees Fahrenheit and the temperature of the flow of gaseous medium across the opening is at a temperature of 400 to 600 degrees Fahrenheit.

13. The method of thermally disassociating an organic mass comprising the steps of claim 9 wherein a plurality of organic masses are removably mounted at spaced intervals on a conveyor which extends through the opening and into the enclosure, the conveyor extending through the tunnel of the enclosure and out of the enclosure through a second opening, transporting the masses on the conveyor through the tunnel and out of the enclosure, and providing within the tunnel a flow of a gaseous medium across the second opening to reduce leakage from the tunnel through the second opening in the enclosure.

14. A method of controlling a pyrolytic process in a processing chamber disposed within an enclosure having substantially air impermeable walls with an opening and an exhaust port, the processing chamber being adapted to operate within a range of internal pressures, said enclosure being provided with means for restricting the flow of ambient air through the opening and into the processing chamber comprising the steps of establishing a gaseous atmosphere within the processing chamber, thereafter heating the atmosphere in the processing chamber to a temperature of between 650 and 800 degrees Fahrenheit and maintaining the temperature of said atmosphere within said temperature range, transporting an organic item for processing through the opening into the processing chamber, continuously exhausting a portion of the gaseous atmosphere within the processing chamber to draw ambient air through the opening into the processing chamber and maintain the pressure of the environment within the processing chamber at a pressure within the operating range of the processing chamber, continuously flowing water vapor into the atmosphere within the processing chamber in a quantity at least equal to 40 percent by volume of the ambient air entering the processing chamber per unit of time, and retaining the organic item within the processing chamber for a sufficient period of time to complete the pyrolytic process, whereby the mixture of air and water entering the process chamber contains insufficient oxygen for supporting a combustion reaction.

15. The method of controlling a pyrolytic process as in claim 14 wherein the step of continuously exhausting a portion of the gaseous atmosphere within the processing chamber maintains the pressure of the atmosphere within the processing chamber at a substantially constant pressure.

* * * * *